US005811934A

United States Patent [19]

Bunk et al.

[11] Patent Number: 5,811,934

[45] Date of Patent: Sep. 22, 1998

[54] ELECTRIC INCANDESCENT HALOGEN LAMP WITH BARREL-SHAPED BULB

[75] Inventors: Axel Bunk, Munich; Andreas Hollstein, Ingolstadt; Ulrich Binder, Munich, all of Germany

[73] Assignee: Patent-Treuhand-Gesellschaft für elektrische Glühlampen mbH, Munich, Germany

[21] Appl. No.: 737,873

[22] PCT Filed: Jun. 1, 1995

[86] PCT No.: PCT/DE95/00718

§ 371 Date: Nov. 25, 1996

§ 102(e) Date: Nov. 25, 1996

[87] PCT Pub. No.: WO95/34910

PCT Pub. Date: Dec. 21, 1995

[30] Foreign Application Priority Data

Jun. 13, 1994 [DE] Germany ..... 44 20 607.0

[51] Int. Cl.[6] ..... H01K 1/50

[52] U.S. Cl. ..... 313/579; 313/344; 313/580

[58] Field of Search ..... 313/112, 113, 313/115, 579, 580, 344

[56] References Cited

U.S. PATENT DOCUMENTS

| | | | |
|---|---|---|---|
| 2,462,858 | 3/1949 | Glauber | 313/344 |
| 3,134,691 | 5/1964 | Kopecky | 313/344 |
| 3,255,375 | 6/1966 | Ward | 313/344 |
| 4,283,653 | 8/1981 | Brett | 313/112 |
| 4,375,605 | 3/1983 | Fontana | 313/313 |
| 5,550,423 | 8/1996 | Oughton | 313/112 |

FOREIGN PATENT DOCUMENTS

| | | | |
|---|---|---|---|
| 2 238 653 | 6/1991 | United Kingdom | 313/344 |

*Primary Examiner*—William L. Oen
*Assistant Examiner*—Max H. Noori
*Attorney, Agent, or Firm*—Frishauf, Holtz, Goodman, Langer & Chick, P.C.

[57] ABSTRACT

An electric incandescent lamp (4), in particular an incandescent halogen lamp, has a bulb or envelope (5), which is shaped as an ellipsoid or optionally ellipsoidlike (barrel-shaped body) and provided with an IR layer (8). Located inside the bulb (5) axially is a compact filament (2') of circular-cylindrical outer contour; the focal lines of the ellipsoid-like barrel-shaped body each coincide approximately with the last luminous winding on the two ends of the filament. This improves lamp efficiency. The compact filament is preferably in the form of a helical coil (2'), whose power supply lead (**10*b*) remote from the seal is returned to inside the helical coil (2'**), or is shaped like a double helix.

14 Claims, 6 Drawing Sheets

ELECTRIC INCANDESCENT HALOGEN LAMP WITH BARREL-SHAPED BULB

FIELD OF THE INVENTION

Figure 1A:
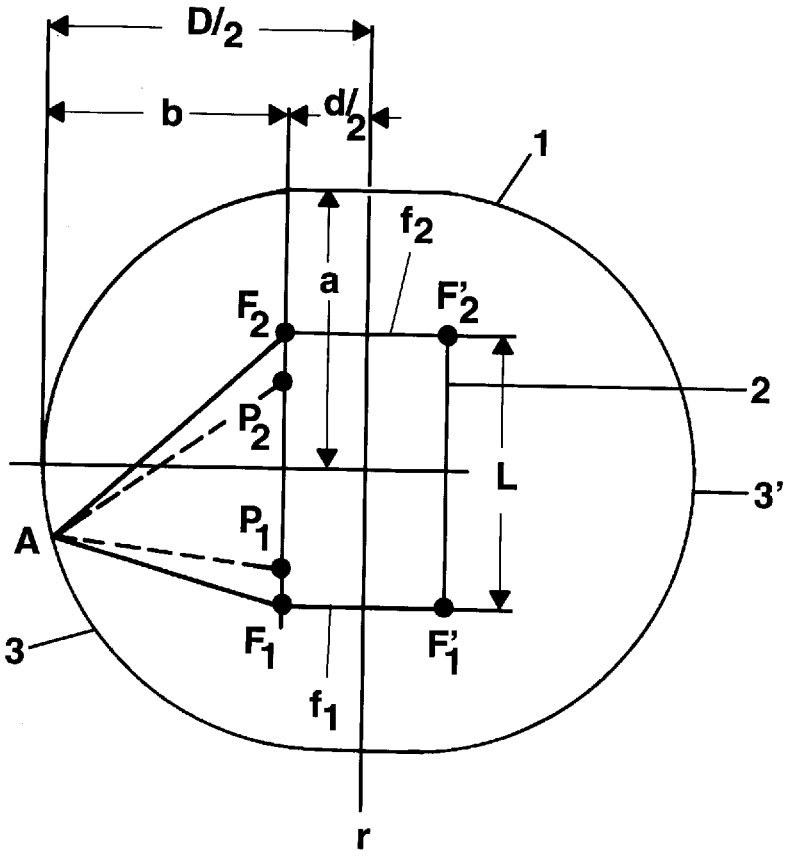

The invention relates to an electric incandescent lamp, and more particularly to an incandescent halogen lamp having a rotation-symmetrical bulb or envelope, and to filaments that are suitable for such incandescent lamps.

BACKGROUND

Incandescent halogen lamps, both in general lighting and for special lighting purposes, are often used in combination with a reflector, such as in projection technology.

The rotationally symmetrical form of the lamp bulb or envelope, combined with an infrared-radiation-reflecting coating—hereinafter called an IR layer for short—applied to the inner and/or outer surface of the bulb has the effect that a majority of the IR radiation power produced by the filament is reflected back. The resultant increase in lamp efficiency can be utilized to increase the temperature of the filament and consequently the light flux, if the electrical power consumption is constant. On the other hand, a given light flux can be attained with less electrical power consumption—an advantageous "energy-saving effect". Another desirable effect of the IR layer is that markedly less IR radiation power is emitted through the bulb, heating the environment, than in conventional incandescent lamps.

Because of unavoidable absorption losses in the IR layer, the power density of the IR radiation components inside the bulb decreases with the number of reflections, and consequently the efficiency of the incandescent lamp drops also. It is therefore decisive for the actually attainable increase in efficiency to minimize the number of reflections required to return the individual IR rays to the filament.

This type of lamp is disclosed for instance in U.S. Pat. No. 4,160,929Thorington et al., European Patent EP A 0 470 496, and German Patent Disclosure DE-OS 30 35 068. U.S. Pat. No. 4,160,929 teaches that to optimize lamp efficiency, the geometric shape of the filament must be adapted to that of the bulb. Moreover, the filament must be positioned as exactly as possible in the optical center of the bulb.

As a result, a wave front originating at the surface of the filament is reflected back, unimpeded, by the bulb surface. Aberration losses are consequently minimized. A spherical bulb, for instance, should in an ideal case have a centrally located and likewise spherical filament. Because of the limited ductility of the tungsten wire that is used as a rule, however, coil shapes for this purpose are attainable only to a greatly limited extent. A cubelike coil has been proposed as a rough but practical approximation for a sphere. In another embodiment, the coil has its largest diameter in its middle. That diameter decreases successively toward the two ends of the coil. For an ellipsoid bulb shape, it has been proposed that one filament be located at each of the two focal points of the ellipsoid.

EP A 0 470 496 discloses a lamp with a spherical bulb, with a cylindrical filament located in the center. This reference teaches that the losses of efficiency from the deviation of the filament from the ideal spherical shape can be kept acceptably low on the following preconditions. Either the bulb diameter and filament diameter or length must be adapted carefully to one another within a tolerance range, or the diameter of the filament must be markedly less (less than a factor of 0.05) than that of the bulb. A lamp with an ellipsoid bulb in whose focal line an elongated filament is axially arranged is also disclosed.

German Patent Disclosure DE-OS 30 35 068 provides teaching for the sake of minimizing the aberration losses, which even in the last embodiment above are unavoidable. In this disclosure, the two focal points of the ellipsoid bulb are located on the axis of the cylindrical filament and at predetermined distances from its respective ends.

THE INVENTION

The object of the invention is to overcome the disadvantages mentioned and to disclose an incandescent lamp that excels in having an efficient return of the emitted IR radiation to the filament and consequently high efficiency. Moreover, compact lamp dimensions at high radiant densities or luminance are to be attained, as sought particularly for low-voltage incandescent halogen lamps.

A further object is to disclose an especially compact design of the filament, which is suitable in particular but not exclusively for lamps according to the invention.

Briefly, the fundamental concept of the invention is based on shaping the rotationally symmetrical bulb wall in such a way that nearly all the IR rays that are generated on the jacket face of a filament of substantially circular-cylindrical outer shape located axially inside the bulb will return to the filament after being reflected from the bulb wall.

The bulb surface substantially corresponds to an ellipsoidlike barrel-shaped body and is generated by the rotation of an elliptical portion, or only approximated elliptical portion. The axis of rotation is located in the plane of the elliptical portion and is shifted parallel by some distance from the long half-axis thereof. As a result, the two focal points of the elliptical portion each describe an annular focal line.

In a preferred embodiment, the spacing, or shift, of the axis of rotation is approximately equivalent to the radius of the approximately circular-cylindrical envelope curve of the filament. The length of the filament is approximately equivalent to the spacing of the two focal lines, or may deviate from that slightly. As a result, the two annular focal lines of the barrel-shaped body each approximately coincide with the last luminous winding on the two ends of the filament.

Axially arranged single or double coils of tungsten are used for the filament. The geometrical dimensioning or in other words the dimension, pitch and length depends, among other factors, on the desired electrical resistance R of the coil, which in turn depends on the desired electrical power consumption P for a given supply voltage U. Because $P=U^2/R$, the coils in high-voltage (HV) lamps are as a rule longer than in low-voltage (LV) types.

The filament is electrically conductively connected to two power supply leads, which are extended to the outside in gas-tight fashion and are located either both on one end of the bulb, or are located separately on the two opposed ends of the bulb. The sealing is generally effected via a pinch. Some other sealing technique, such as fusing in of a plate, is also possible. The version which is closed on one end is especially suitable for LV applications. In that case, because of the relatively short filament, very compact lamp dimensions are attained. In the case of the comparatively long and as a rule less rigid coils for HV applications, it may be advantageous to support the filament with an axially arranged retaining device of electrically insulating heat-resistant material, as has been proposed for instance in German Utility Model DE-GM 91 15 714. In the case of bulbs closed on both ends, this feature may be dispensed with under some circumstances, because in that case the coil can be fixed on both ends by means of a respective substantially rigid, axially arranged power supply lead.

To optimize lamp efficiency, it is advantageous if as large as possible a portion of the bulb wall can be used as an effective reflection surface. This can be attained in particular by providing that on one or optionally both ends, the lamp bulb has a neck in the region of the power leadthrough. The neck surrounds the power leadthrough as closely as possible and merges with a seal. To enable inserting the filament into the bulb through the neck during manufacture of the lamp, the inner diameter z of the lamp neck must be somewhat larger, optionally on at least one end of the bulb, than the outer diameter d of the filament. Typical values for the difference between the two diameters are up to 5 mm, but preferably less than 2 mm. If D is the largest outer diameter perpendicular to the rotary axis of the bulb, then the overall relationship is $d<z<D$. Tests have shown that the lamp of the invention can be operated with good efficiency and compact dimensions as long as the quotient d/D of the outer diameter d of the filament and the largest outer diameter D of the bulb is greater than approximately 0.15, and is preferably in the range between greater than 0.15 and less than 0.5, and the quotient d/z of the outer diameter d of the filament and the inner diameter z of at least one neck is greater than approximately 0.25, preferably greater than or equal to 0.4.

Figure 1B:
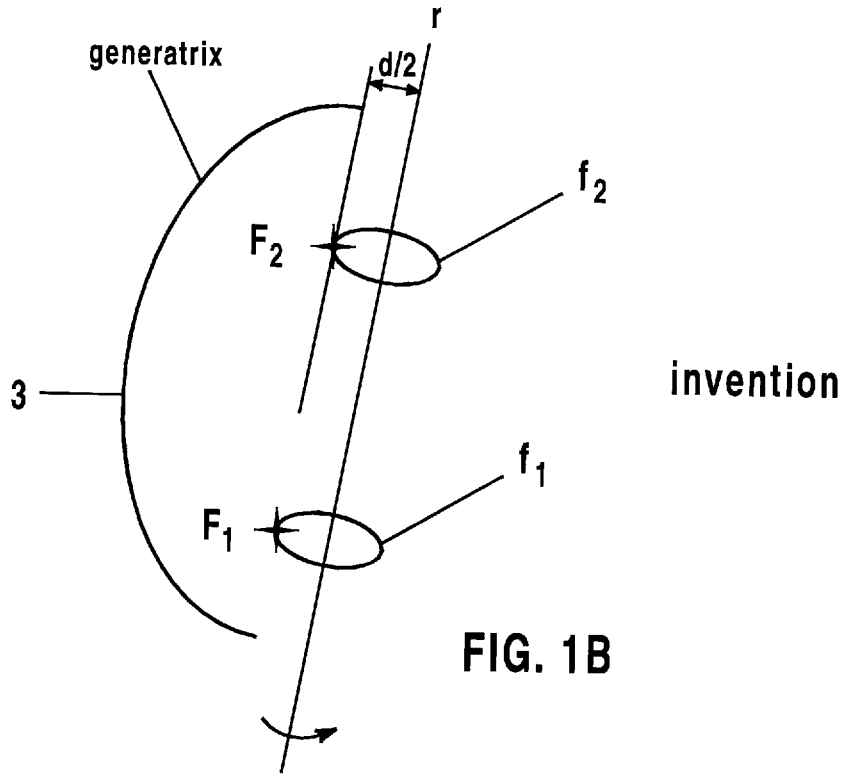
Figure 1C:
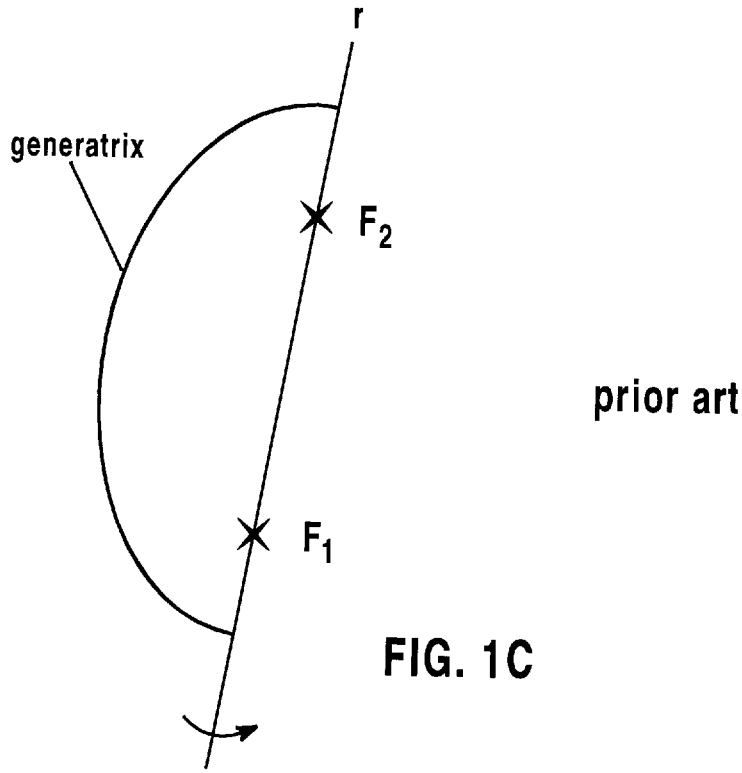

The fundamental relationships can be explained especially simply with the aid of the schematic longitudinal section shown in FIG. 1 through a lamp bulb. For the sake of simplicity, the bulb is shown as a closed ellipsoid barrel-shaped body 1 of negligible wall thickness, in whose interior a filament 2 of circular-cylindrical outer contour is centrally axially arranged. The power supply leads and the pinch (or pinches) are not shown, for the sake of simplicity. The longitudinal axis r of the filament 2 forms the rotary axis of the barrel-shaped body 1. The portion of the barrel-shaped body that is immediately adjacent to the jacket face of the filament is generated by an ellipse half 3. The four corners of the rectangular longitudinal section of the filament are identical to the focal points $F_1$, $F_2$, $F_1'$, $F_2'$ of the two opposed ellipse halves 3, 3' of the contour of this bulb portion. Because of the rotational symmetry, the two focal points of the generating ellipse half describe two corresponding circular focal lines $f_1$ and $f_2$, respectively, which coincide with the two circular edges of the outer contour of the circular-cylindrical filament. The maximum spacing between the jacket face of the filament and the bulb wall is accordingly equivalent to the short half-axis b of the ellipse half that generates the partial bulb contour.

DEFINITION

The term "barrel-shaped" used herein and in the claims thus refers to a body of rotation which, in cross section, in a plane parallel to a central axis r (FIG. 1) and at any angle about this central axis, is elliptical, with the focal points of the ellipse offset (d/2, FIG. 1) from the central axis r. The circumference of this body, thus, is generated by a half ellipse in which the focal points, themselves, rotate or nutate, in a circle of radius d/2 about the central axis r.

The foregoing definition clearly contrasts a "barrel-shaped body", as defined, from an ellipsoid which is generated by a single ellipse (or half ellipse), whose focal points are fixed and on the axis of rotation.

The decisive advantage over previous solutions is that now all the rays that originate at the outer circumferential, i.e. the jacket face or generated surface, return to this generated surface, or face after a single reflection at the bulb wall. This is shown as an example for the two arbitrarily selected rays $F_1AF_2$ and $P_1AP_2$. The reason is that all the rays that originate somewhere along the connecting line $F_1F_2$ between the two focal points $F_1$, $F_2$ are reflected at a smaller angle from plumb, at point A of the ellipse half 3, than the corresponding focal point rays. Because of the rotational symmetry, this is true for all the rays that originate at the outer surface of the filament and extend in the planes that intersect at the rotary axis (that is, the longitudinal axis r of the bulb).

For the rays that extend in the planes at right angles to the rotary axis, the contours of the bulb and the filament each correspond to circles concentric with one another. Approximately circular waves therefore form in these planes, and their wave fronts are adapted to the corresponding bulb contour and are consequently reflected back again unimpeded.

The geometrical dimensioning of the coil, especially its length L and its diameter d, is calculated substantially from the electrical power consumption contemplated. With the aid of the ellipse equation (see for example McGraw-Hill Encyclopedia of Science, Page 560), a relationship can thus be given for the long half-axis a of the ellipse half (or elliptical portion) that generates the ellipsoid portion of the barrel-shaped body:

$$a=\sqrt{\left(\frac{D-d}{2}\right)^2+\left(\frac{L}{2}\right)^2}.$$

In this illustration, the short half-axis b and thus the largest diameter $D=2\cdot(b+d/2)$ of the bulb are a "freely" selectable parameter. That is, while preserving the fundamental reflection relationships described, different kinds of compact bulbs can be achieved.

In a first embodiment, the IR layer is applied to the inner surface of the bulb. According to the above teaching, this inner surface is shaped as an approximately optimal reflection surface for the IR rays originating at the jacket face of the filament. However, during the manufacture of the bulb, the shaping of the inner surface cannot generally be monitored as exactly as is possible for the outer face—for instance by means of suitable forming rollers. As a result, the IR layers does not generally have exactly the calculated contour. Moreover, in this case the material of the coating must be resistant to the fill.

In a second embodiment, the IR layer is located on the outer surface of the bulb, so there is no need to take the fill into consideration. Moreover, the IR layer is simple to apply in that case. However, now the IR rays originating at the jacket face of the filament are broken at the boundary face between the medium inside the bulb and the medium of the bulb wall. The resultant offset of the rays means that—depending on the wall thickness and the difference in index of refraction at the boundary face—some rays, and especially those that originate at the focal points, are no longer reflected back into the focal line. To optimize lamp efficiency, it is therefore advantageous to compensate for this offset of rays by means of a suitably adapted bulb contour. In this case, the generatrix is a slightly modified elliptical portion (not shown), which must be calculated numerically. The peripheral condition is again that all the rays that originate at the jacket face of the filament and extend in the planes that intersect in the rotary axis (i.e., the longitudinal axis of the bulb) return to the jacket face again after being reflected once at the IR layer.

In a preferred embodiment with a bulb closed on one end, the inner diameter of the neck is only insignificantly larger than the outer diameter of the filament. For this reason, especially when the bulb is closed by a pinch seal that is relatively wide to allow the foils to pass through, the bulb has a pronounced constriction in the region of the neck. As a result, an especially large effective reflection surface area of the overall bulb and consequently correspondingly high efficiency are attained. For this purpose, an especially compact design of the power supply leads and of the filament have been developed. The power supply leads are extended inside the outer diameter of the filament, from the seal to the ends of the filament. In one embodiment, the power supply lead connection to the end of the filament remote from the seal is returned to inside the filament, preferably centrally and axially. This prevents shading of the coiled surface. An especially compact arrangement is a double helix-like coil structure. The filament then comprises two coil segments that mesh with one another three-dimensionally. In one embodiment, the two coil segments are embodied as identical helical lines. These lines are arranged such that their two longitudinal axes coincide and are offset from one another axially by approximately one-half the pitch height. The pitch height is defined here as the distance within which the helical lines execute one complete turn. The two coil segments are joined together on the first end of the filament. On the opposite end of the filament, the two coil segments each merge with a respective power supply lead.

These compact filament forms can be used not only in barrel-shaped bodies but also in other shapes of bulbs, such as ellipsoid or spherical bulbs, as has been noted at the outset.

Advantageously, the pitch of the coiling of the filament is as small as possible, so that the IR rays reflected by the bulb will be highly likely to strike the filament.

This kind of compact design of the filament can be achieved especially easily in LV lamps, because in them the thickness of the coil wire is especially great. Thus, short filaments of high rigidity can be produced, in accordance with the above-described embodiments.

The compact geometrical dimensions predestine this lamp especially for combination with an external reflector, such as that used in protection technology. The optical system efficiency is in fact higher, the better the light source used approximates an ideal point-type light source.

To reinforce centering of the filaments, in one variant at least one of the two power supply leads of the filament is spread apart, in the direction of its end remote from the filament, to a spacing greater than the inside diameter z of the lamp neck. The spreading is effected over the entire length, or only over a portion of the respective power supply lead. Preferably, both power supply leads have the same degree of spreading symmetrically to the longitudinal axis of the filament. When the filament is inserted into the bulb, the ends of the power supply leads remote from the filament are braced against the inner wall of the neck of the lamp and thus bring about forced centering of the filament inside the bulb in one plane.

The bulb is typically filled with inert gas, such as $N_2$, Xe, Ar and/or Kr. In particular, it contains halogen additives that maintain a tungsten-halogen cycle process, to counteract blackening of the bulb. The bulb comprises a light transmissive material, such as quartz glass.

The lamp may be operated with an outer bulb. If an especially strong reduction of the IR capacity projected into the environment is desired, then the outer bulb may also have an IR layer.

The IR layer for instance may be in the form of an interference filter known per se—typically, a succession of alternating dielectric layers with different indexes of refraction. The basic layout of suitable IR layers is described for instance in EP A 0 470 496.

DRAWINGS

Figure 2:
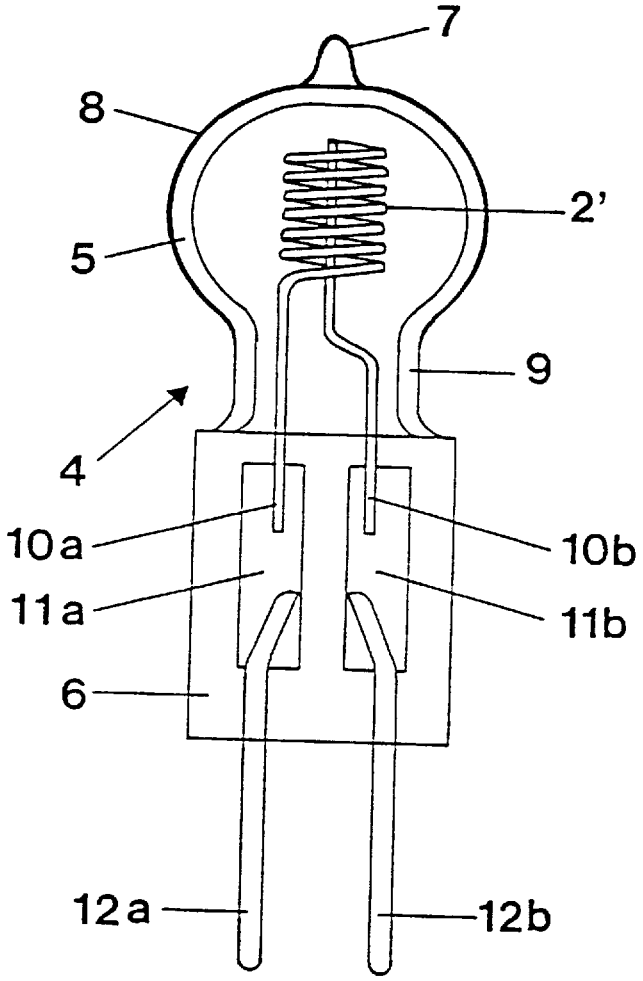
Figure 3:
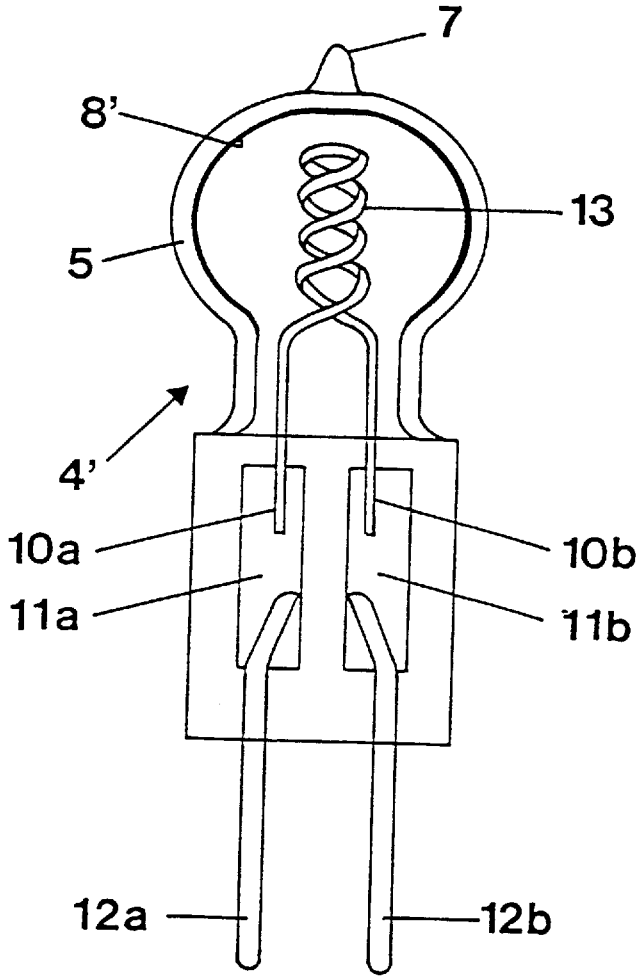
Figure 4:
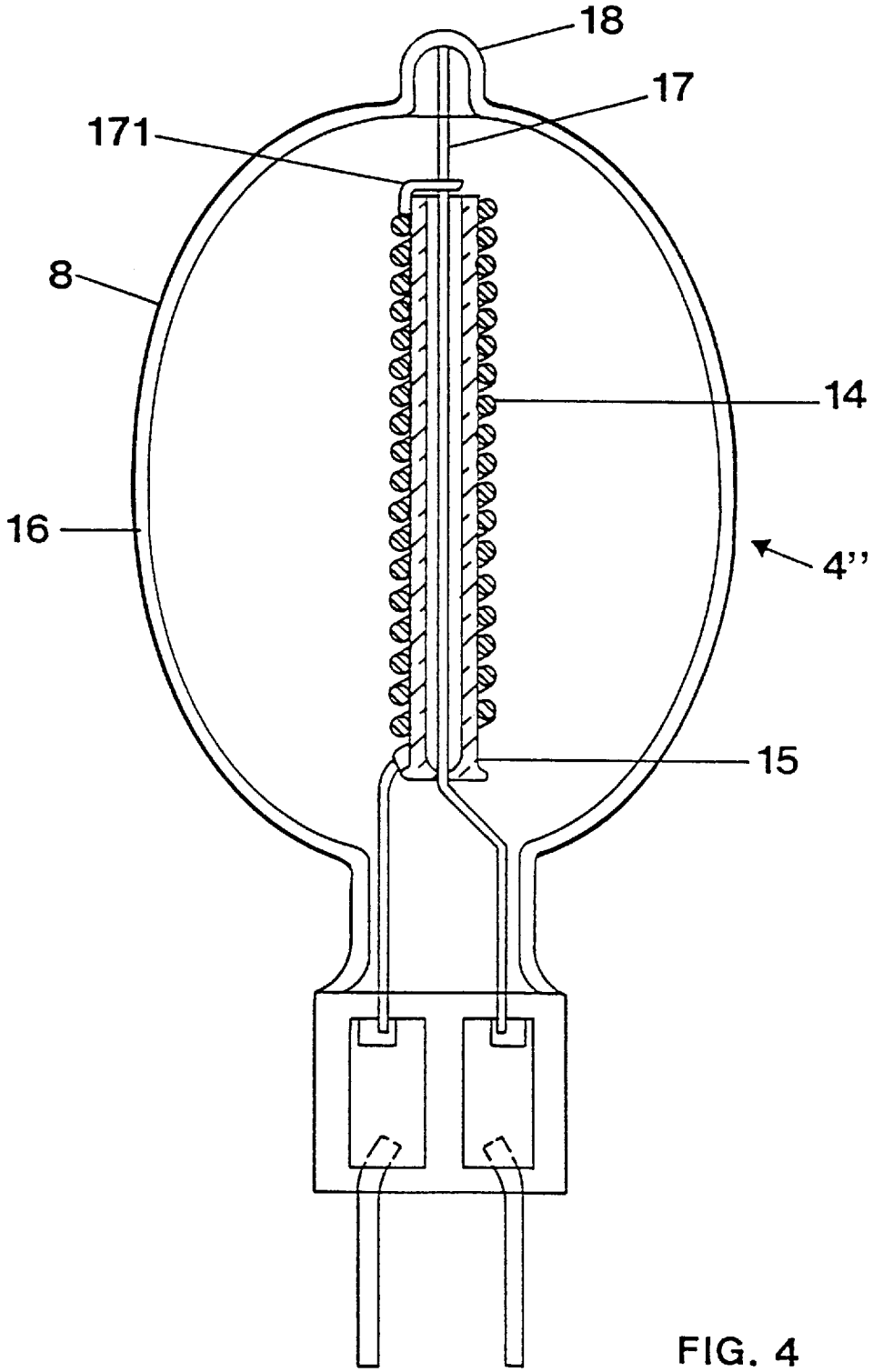
Figure 5:
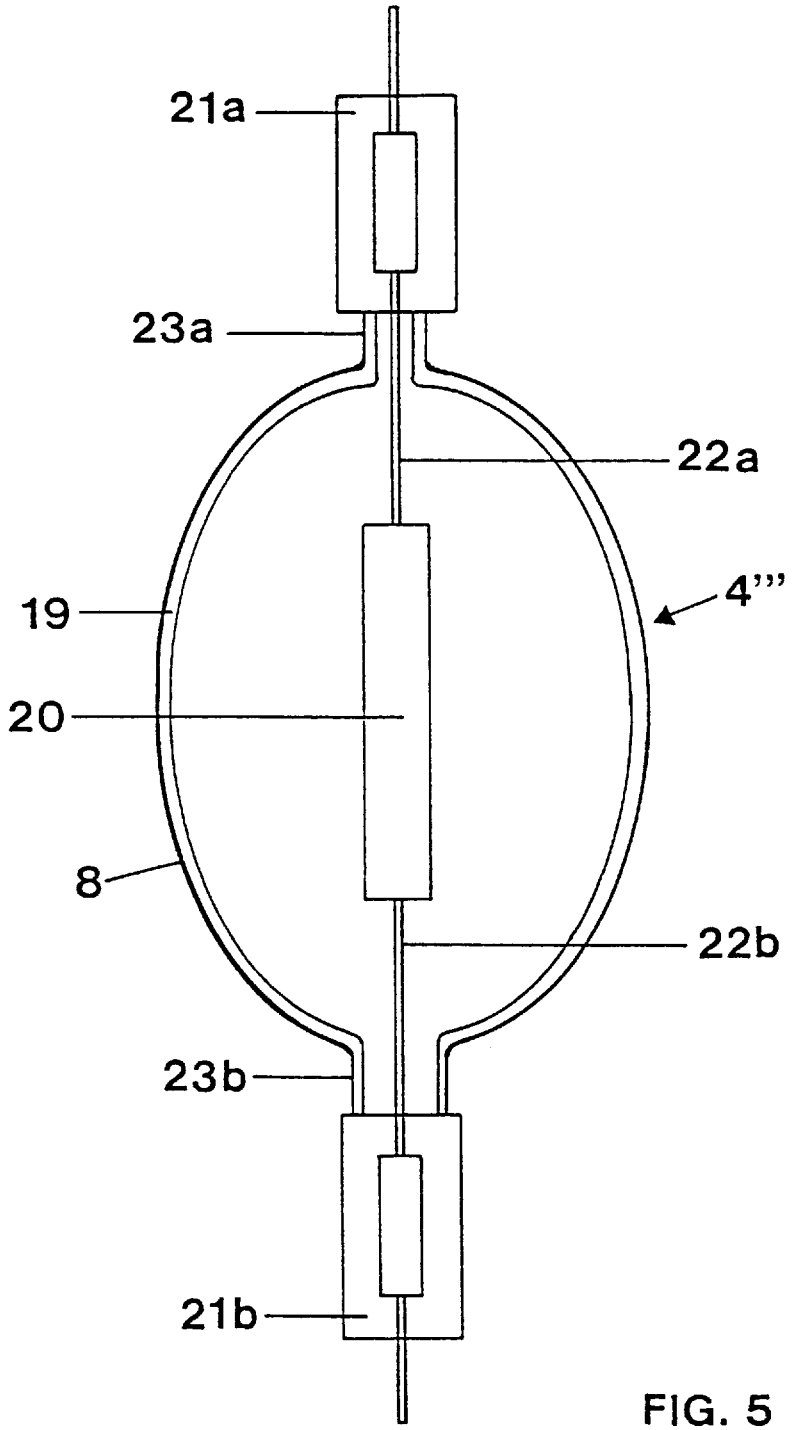

The invention will be described in further detail below in terms of several exemplary embodiments. Shown are in:

FIG. 1, the basic principle of the invention, illustrated by a longitudinal section through an ellipsoid barrel-shaped body;

FIG. 2, an exemplary embodiment of an LV lamp, pinched on one end, with coating on the outside;

FIG. 3, an exemplary embodiment of an LV lamp, pinched on one end, with coating on the inside;

FIG. 4, an exemplary embodiment of a HV lamp, pinched on one end, with coating on the outside;

FIG. 5, an exemplary embodiment of an HV lamp, pinched on both ends, with coating on the outside.

In FIG. 2, a first exemplary embodiment of a lamp 4 according to the invention is schematically shown. This is an incandescent halogen lamp with a rated voltage of 12 V and a rated output of 75 W. It comprises a lamp bulb or envelope 5, pinched on one end, which is shaped as an ellipsoidlike barrel-shaped body. It is made of quartz glass with a wall thickness of approximately 1 mm, and on its first end it merges with a neck 9 that ends at a pinch seal 6. On its opposite end, it has a pump tip 7. Applied to its outer surface is an IR layer 8, comprising an interference filter with more than 20 layers of $Ta_2O_5$ and $SiO_2$. In this way, an especially dimensionally stable form of the IR layer is attained, since in the manufacture of the bulb 5, the calculated contour of the ellipsoid barrel-shaped body is imposed upon the outer surface of the bulb. The largest outer diameter of the bulb 5 is approximately 10 mm, and the length of the bulb neck 9 is approximately 3 mm, for an outer diameter of about 6 mm. A fill of approximately 6670 hPa of xenon (Xe), with an admixture of 5600 ppm of hydrogen bromide (HBr), and an axially arranged filament 2' with a length of 3.7 mm and an outer diameter of 2.2 mm are all located in the inside of the bulb. The result is a ratio between the outer diameter of the filament 2' and the inner diameter of the neck 9 of approximately 0.7. The ratio between the outer diameter of the filament 2' and the largest outer diameter of the bulb 5 is approximately 0.22. The geometry of the filament 2' and the contour of the bulb 5 are adapted to one another in such a way that the last turn of each of the two ends of the wound or coiled filament 2' is nearly identical with the focal lines of the inside of the bulb 5, see lines $f_1$, $f_2$ of FIG. 1.

The filament 2' is made from tungsten wire, with a diameter of 227 $\mu$m and a length of 94 mm; at room temperature, its electrical resistance is approximately 0.09 Ω. The tungsten wire is wound into a single helical coil, which has eleven turns with a pitch of 316 $\mu$m and a core diameter of 1746 $\mu$m, corresponding to a pitch factor of about 1.39 and a core factor of about 7.7.

The power supply leads 10*a*, 10*b* are formed directly by the coil wire and are joined to molybdenum foils 11*a*, 11*b* in the pinch seal 6. The molybdenum foils 11*a*, 11*b* are in turn connected to outer base prongs 12*a*, 12*b*. The first power supply lead 10*a* is extended parallel to the longitudinal axis of the lamp and in alignment with the circumferential surface of the filament 2'. The second power supply lead 10*b* of the filament 2' is bent toward the axis and extends centrally along the axis of the windings to the end remote from the base. In this way, any shading thereby is prevented.

The lamp has a color temperature of approximately 3150 K. The light flux is 2100 lm, corresponding to a light yield of 28.7 lm/W. In comparison to operation of the same lamp without an IR layer, up to 25% of the electrical energy can be saved.

FIG. 3 shows a second exemplary embodiment of a lamp 4' according to the invention, in a schematic illustration. In contrast to the first exemplary embodiment, the IR layer 8' is on the inside of the bulb 5. Unlike the conditions in FIG. 2, the IR rays therefore strike the IR layer directly, without first passing through the wall of the bulb 5. Consequently, there is no ray offset from refraction. The axially centrally arranged, singly coiled filament 13 is shaped in the manner of a double helix directly from a 227-$\mu$m-thick tungsten wire. One half of the coiling of the coil body is extended in the direction of the pump tip 7, in the manner of a clockwise screw. The second half is coiled in the same direction of rotation but in the opposite longitudinal direction. The two power supply leads 10*a*, 10*b* are formed directly by the ends of the coil wire. They are located in the plane of the pinch seal 6 and are guided parallel to one another—approximately at the spacing of the diameter of the filament coil—in each case from the end near the base of the filament toward the molybdenum foils 11*a, b* connected to the base pins 12*a, b*. If the fill comprises 6670 hPa of xenon (Xe) with an admixture of 5600 ppm of hydrogen bromide (HBr), then up to 30% of the energy can be saved, compared to operation of the same lamp without a coating.

In FIG. 4, a further exemplary embodiment of a lamp 4" is schematically shown. This is an HV incandescent halogen lamp, pinched on one end and with coating 8 on the outside, which is suitable for direct operation at a mains voltage of 230 V. The doubly coiled filament 14 comprises 18 helical winding turns. The turns are wound onto an electrically insulating tube 15 of $Al_2O_3$ ceramic, which assures good mechanical and thermal stability. This is of great importance for optimal efficiency of this lamp 4", because only in this way can the jacket face of the filament 14 be fixed with the requisite accuracy between the two focal lines of the bulb 16. This is particularly true when the lamp 4" is operated in a horizontal position. In that case, the tube 15 prevents sagging of the long, not very rigid filament 14. The end of the filament 14 remote from the seal is electrically conductively connected to the internal return 17 via a tungsten hoop 171. Because of the support of the internal return 17 in the pump tip 18, the filament 14 is axially centered. This type of retaining a filament is well known, and illustrated, for example, in DE-GM 91 15 714, assigned to the assignee of this application.

In FIG. 5, a further exemplary embodiment of a lamp 4"' is schematically shown. This is an HV incandescent halogen lamp, pinched on both ends and with coating 8 on the outside, which is suitable for direct operation at a mains voltage of 120 V. Inside the bulb 19, a singly coiled filament 20 is arranged concentrically; as in the previous examples, the last winding of each of the two ends of the filament 20 are nearly identical with the focal lines of the bulb 19. The filament 20 is retained by means of two axially arranged power supply leads 22*a*, 22*b*. Between the bulb 19 and each of the two pinches 21*a*, 21*b*, the lamp 4"' has a respective neck 23*a* and 23*b*. The inside diameter of the first neck 23*a* is only insignificantly larger than the outer diameter of the filament 20. During production, the filament 20 is inserted through this neck 23*a* into the bulb 19. The inside diameter of the oppositely located neck 23*b* is only insignificantly greater than the diameter of the power supply lead 22*b* that it closely surrounds. As a result, the lamp 4"' has a larger reflective surface area on this end than on the end opposite it. When operated vertically, the lamp is preferably oriented such that the end of the lamp that has the narrower neck 23*b* points downward. In this way, a temperature gradient caused by convection between the two ends of the filament is counteracted.

The invention is not limited to the exemplary embodiments discussed. In particular, individual characteristics of different exemplary embodiments may also be combined with one another.

What is claimed is:

1. An electric incandescent lamp, optionally an incandescent halogen lamp (4-4"'), having a rotationally symmetrical bulb or envelope (5, 16, 19), which has a longitudinal axis (r);

an infrared (IR) radiation reflecting layer (8) on a wall surface of the bulb; and a coiled filament (2, 2', 13, 14, 20) which, when energized, emits visible light, located axially in the bulb and retained in the bulb by means of two power supply leads (10*a*, 10*b*–22*a*, 22*b*), characterized in that the bulb (5, 16, 19) forms a barrel-shaped body of rotation of ellipsoid or, optionally, approximately ellipsoid partial contour, which body, in cross section, in a plane parallel to a central axis (r) and at an angle about the central axis, has a generatrix which is elliptical or approximately elliptical, with the focal points (F1, F2) of the ellipse offset by a predetermined distance (d2) from the central axis (r), so that the circumference or contour of this body will be generated by a half, at least part-ellipse or approximate ellipse, in which the focal points (F1, F2), themselves, rotate or nutate about the central axis (r) to form focal lines (f1, f2) which are circular, or form focal circles, which focal circles have a radius of said predetermined distance (d/2).

2. An electric incandescent lamp, optionally an incandescent halogen lamp (4–41'), having a rotationally symmetrical bulb or envelope (5, 16, 19), which has a longitudinal axis (r);

an infrared (IR) radiation reflecting layer (8) on a wall surface of the bulb; and a coiled filament (2, 2', 13, 14, 20) which, when energized, emits visible light, located axially in the bulb and retained in the bulb by means of two power supply leads (10*a*, 10*b*–22*a*, 22*b*), characterized in that the bulb (5, 16, 19) forms a barrel-shaped body of rotation of ellipsoid or, optionally, approximately ellipsoid partial contour, which body, in cross section, in a plane parallel to a central axis (r) and at an angle about the central axis, has a generatrix which is elliptical or approximately elliptical, with the focal points (F1, F2) of the ellipse offset by a predetermined distance (d2) from the central axis (r), so that the circumference or contour of this body will be generated by a half, at least part-ellipse or approximate ellipse, in which the focal points (F1, F2), themselves, rotate or nutate about the central axis (r) to form focal lines (f1, f2) which are circular, or form focal circles, which focal circles have a radius of said predetermined distance (d/2); and in that the axial positions of said two focal lines or circles (f1, f2) of the ellipsoid or, optionally, approximately ellipsoid partial contour of said barrel-shaped body (1, 5, 15, 19) each coincide approximately with the last luminous turn on two ends of the coiled filament (2, 2', 13, 14, 20).

3. The electric incandescent lamp of claim 1, characterized in that the IR-radiation-reflecting layer (8') is applied to the inner surface of the bulb (5).

4. The electric incandescent lamp of claim 1, characterized in that the ellipsoid or, optionally, part ellipsoid-like portion of the contour of the barrel-shaped body (1, 5, 16, 19) is generated by an at least approximated elliptical portion (3).

5. The electric incandescent lamp of claim 4, characterized in that the long half-axis of the at least approximated elliptical portion is shifted parallel to the longitudinal axis of the lamp, optionally by approximately the outer radius of the coiling of the filament (2, 2', 13, 14, 20).

6. The electric incandescent lamp of claim 5, characterized in that the length of the filament (2, 2', 13, 14, 20) is approximately equivalent to the spacing of the two focal points of the elliptical portion.

7. The electric incandescent lamp of claim 1, characterized in that the bulb (5, 16, 19) has at least one neck (9, 23*a*, 23*b*) on at least one end, which neck surrounds at least one power supply lead (10, 10*b*, 22*a*, 22*b*) as closely as possible and is sealed in gas-tight fashion (6, 21*a*, 21*b*).

8. The electric incandescent lamp of claim 7, characterized in that the quotient d/D of the outer diameter d of the filament (2', 13, 14, 20) and the largest outer diameter D of the bulb 5, 16, 19) is greater than approximately 0.15, and the quotient d/z of the outer diameter d of the filament (2', 13, 14, 20) and the inner diameter z of the at least one neck (9, 23*a*) is greater than approximately 0.25.

9. The electric incandescent lamp of claim 8, characterized in that the quotient d/z is preferably greater than or equal to 0.4.

10. The electric incandescent lamp of claim 8, characterized in that the quotient d/D is preferably in the range between 0.15 and 0.5.

11. The electric incandescent lamp of claim 1, characterized in that two power supply leads (10*a*, 10*b*) are provided, guided jointly through a neck (9) of the bulb, said power leads having a spacing that is less than or equal to the outer diameter d of the filament (2', 13).

12. The electric incandescent lamp of claim 1, characterized in that the filament is in the form of a helical coil (2'), and has a power supply lead (10*b*) remote from a bulb seal, which is led back to the seal inside the helical coil (2').

13. The electric incandescent lamp of claim 1, characterized in that the filament (14) is reinforced by an axially located retaining device (15) of electrically insulating material positioned within the coiling of the filament.

14. The electric incandescent lamp of claim 1, characterized in that the filament is shaped as a double helix (13).

* * * * *

UNITED STATES PATENT AND TRADEMARK OFFICE

CERTIFICATE OF CORRECTION

PATENT NO. : 5,811,934

DATED : 22 SEP 1998

INVENTOR(S) : Axel BUNK et al

It is certified that error appears in the above-identified patent and that said Letters Patent is hereby corrected as shown below:

Column 10, line 19, (Claim 13), change "Claim 1" to --Claim 12--.

Item [56] References Cited, under U.S. Patent Documents, insert -- 3,355,619 11/1967 Reed, Sr.

4,160,929 7/1979 Thorington et al --, and under Foreign Patent Documents, insert --2 449 969 9/1980 France--.

Signed and Sealed this

Twenty-first Day of September, 1999

*Attest:*

Q. TODD DICKINSON

*Attesting Officer*

*Acting Commissioner of Patents and Trademarks*